United States Patent [19]

Watanabe et al.

[11] Patent Number: 4,819,443

[45] Date of Patent: Apr. 11, 1989

[54] EXPANSION VALVE

[75] Inventors: Masaru Watanabe, Kawasaki; Osamu Yamamoto, Tokyo, both of Japan

[73] Assignee: Fujikoki America, Inc., Dallas, Tex.

[21] Appl. No.: 67,865

[22] Filed: Jun. 30, 1987

[51] Int. Cl.[4] ..... F25B 41/04

[52] U.S. Cl. ..... 62/225; 236/92 B; 277/27; 277/212 R

[58] Field of Search ..... 62/225; 236/92 B; 374/201; 277/27, 212 R

[56] References Cited

U.S. PATENT DOCUMENTS

| | | | |
|---|---|---|---|
| 1,120,159 | 12/1914 | Pollard | 62/225 X |
| 2,379,286 | 6/1945 | Dodson | 62/225 X |
| 2,520,191 | 8/1950 | Aughey et al. | 236/92 B X |
| 2,539,062 | 1/1951 | Dillman | 62/225 |
| 3,010,518 | 11/1961 | Harmon | 277/212 X |
| 3,064,245 | 11/1962 | Lindberg, Jr. | 374/201 X |
| 3,082,825 | 3/1963 | Hannen, Sr. | 277/212 X |
| 3,252,294 | 5/1966 | Heidorn | 62/207 |
| 3,296,816 | 1/1967 | Weibel, Jr. et al. | 62/210 |
| 3,330,569 | 7/1967 | Skinner | 277/212 |
| 3,450,345 | 6/1969 | Orth et al. | 236/92 |
| 3,525,234 | 8/1925 | Widdowson | 62/217 |
| 3,537,645 | 11/1970 | Treder | 236/92 |
| 3,574,351 | 4/1941 | Stoltman | 277/212 |
| 3,592,018 | 7/1971 | Widdowson | 62/222 |
| 3,702,066 | 11/1972 | Beatenbough et al. | 62/222 |
| 3,708,998 | 1/1973 | Scherer et al. | 62/210 |
| 3,731,498 | 5/1973 | Beatenbough et al. | 62/225 |
| 3,953,984 | 5/1976 | Widdowson | 62/156 |
| 3,962,884 | 6/1976 | Widdowson | 62/217 |
| 3,965,693 | 6/1976 | Widdowson | 62/217 |
| 4,288,032 | 9/1981 | Hetz | 236/56 |
| 4,344,566 | 8/1982 | Gotzenberger | 236/92 B |
| 4,542,852 | 9/1985 | Orth et al. | 236/92 |

FOREIGN PATENT DOCUMENTS

| | | |
|---|---|---|
| 144875 | 2/1983 | Japan . |
| 41772 | 8/1983 | Japan . |
| 130378 | 12/1983 | Japan . |

*Primary Examiner*—William E. Tapolcai

*Attorney, Agent, or Firm*—Richards, Harris, Medlock & Andrews

[57] ABSTRACT

An improved expansion valve (10) is disclosed for use with an air conditioning system (12) for an automobile. High pressure refrigerant flow is modulated through the valve by movement of a valve member (92) in response to the superheat of the low pressure refrigerant flow through a first passage (32) in the expansion valve. The low pressure refrigerant superheat is sensed by a power element (74) containing an adsorbent and gas which deflects a diaphragm (82) to a degree related to the superheat of the low pressure flow. The diaphragm acts on an annular seal retainer (100) to modulate the position of the valve member (92). A cupshaped high pressure seal (104) is provided between the valve member (92) and wall of the passage (54) in which the valve member moves to balance the forces on the valve member exerted by the high pressure refrigerant. The balanced valve member allows use of a compact power element, permitting the body (30) of the valve (10) to be formed of plastic.

6 Claims, 1 Drawing Sheet

EXPANSION VALVE

TECHNICAL FIELD

This invention relates to an improved expansion valve for an air conditioning system, particularly on an automotive air conditioner.

BACKGROUND OF THE INVENTION

In a typical automobile air conditioning system, a refrigerant is compressed by a compressor unit driven by the automobile engine. The compressed refrigerant, at high temperature and pressure, enters a condenser where heat is removed from the compressed refrigerant. The refrigerant then travels through a receiver dryer to an expansion valve. The expansion valve causes the pressure of the refrigerant to drop as it flows through the valve, which causes the refrigerant to change phase from liquid to gas form as it enters the evaporator. In the evaporator, heat is drawn from the environment to replace the latent heat of vaporization, thus cooling the environmental air. The low pressure refrigerant flow from the evaporator returns to the suction side of the compressor to begin the cycle anew.

The high pressure refrigerant flow through the expansion valve must be regulated in response to the degree of superheat in the low pressure refrigerant flow between the evaporator and suction side of the compressor to maximize the air conditioning performance. The superheat is defined as the temperature difference between the actual temperature of the low pressure refrigerant flow and the temperature of evaporation of the flow. Traditionally, the low pressure flow superheat has been sensed remotely by use of a feeler bulb. The feeler bulb is positioned in contact with the pipe carrying the low pressure refrigerant. A pressure carrier extends from the feeler bulb to a power element in the expansion valve which modulates the valve. Many of these components are affected by external thermal disturbances, reducing the accuracy of the modulation. Also, the complexity results in a long "dead time" between a superheat transient in the low pressure refrigerant flow, and a compensating regulation in the expansion valve.

Attempts have been made to improve expansion valve performance. For example, U.S. Pat. No. 3,450,345 discloses a bulbless thermostatic expansion valve. U.S. Pat. No. 3,537,645 also discloses a bulbless expansion valve. Japanese laid-open patent application No. 144,875/1984, and Japanese laid-open utility model application No. 130,378/1985, also illustrate expansion valve designs. However, the need remains for an expansion valve which maximizes performance of the system, while minimizing cost and maximizing reliability.

SUMMARY OF THE INVENTION

In accordance with one aspect of the present invention, an expansion valve is provided for an air conditioner having an evaporator and a compressor. The valve includes a body assembly defining a first flow path for high pressure refrigerant flow from the compressor to the evaporator and a second flow path for low pressure refrigerant flow from the evaporator to the compressor. A valve member is positioned in the first flow path for regulating flow through the first flow path. Structure is positioned within the second flow path for sensing the superheat of the low pressure refrigerant flow and for moving the valve member in response to the sensed superheat to regulate the high pressure refrigerant flow.

In accordance with another aspect of the present invention, the position of the valve member is determined by the balance of forces acting on the valve member which includes a force proportional to the superheat of the low pressure flow. The body assembly defines a uniform diameter passage having a first end and a second end. The compressor side of the high pressure refrigerant flow path opens into the passage along its length. The evaporator side of the high pressure refrigerant flow path is in fluid communication with the first end of the passage. The valve member includes a first portion defining a conical seal surface for sealing against the first end of the passage. The valve member has a second portion defining a stem extending from the conical surface into the passage and beyond the opening of the compressor side high pressure refrigerant flow path to a cylindrical end. An annular seal retainer is received in the second end of the passage which supports the cylindrical end of the valve member concentric with the passage center line. A cup shaped high pressure seal is supported by the seal retainer and slidably seals between the cylindrical end of the valve member and the wall of the passage.

In accordance with another aspect of the present invention, the body assembly comprises a body and a cartridge. The valve member and operating mechanism are positioned within the cartridge, which permits the body to be made of a non-metallic material to reduce cost, facilitate molding of a wide range of exterior body configurations, facilitate thermal isolation between the first and second flow paths and provide other advantages.

BRIEF DESCRIPTION OF THE DRAWINGS

For a more complete understanding of the present invention and the advantages thereof, reference is now made to the following description taken in conjunction with the accompanying drawings, in which.

DETAILED DESCRIPTION

Figures 1, 2:
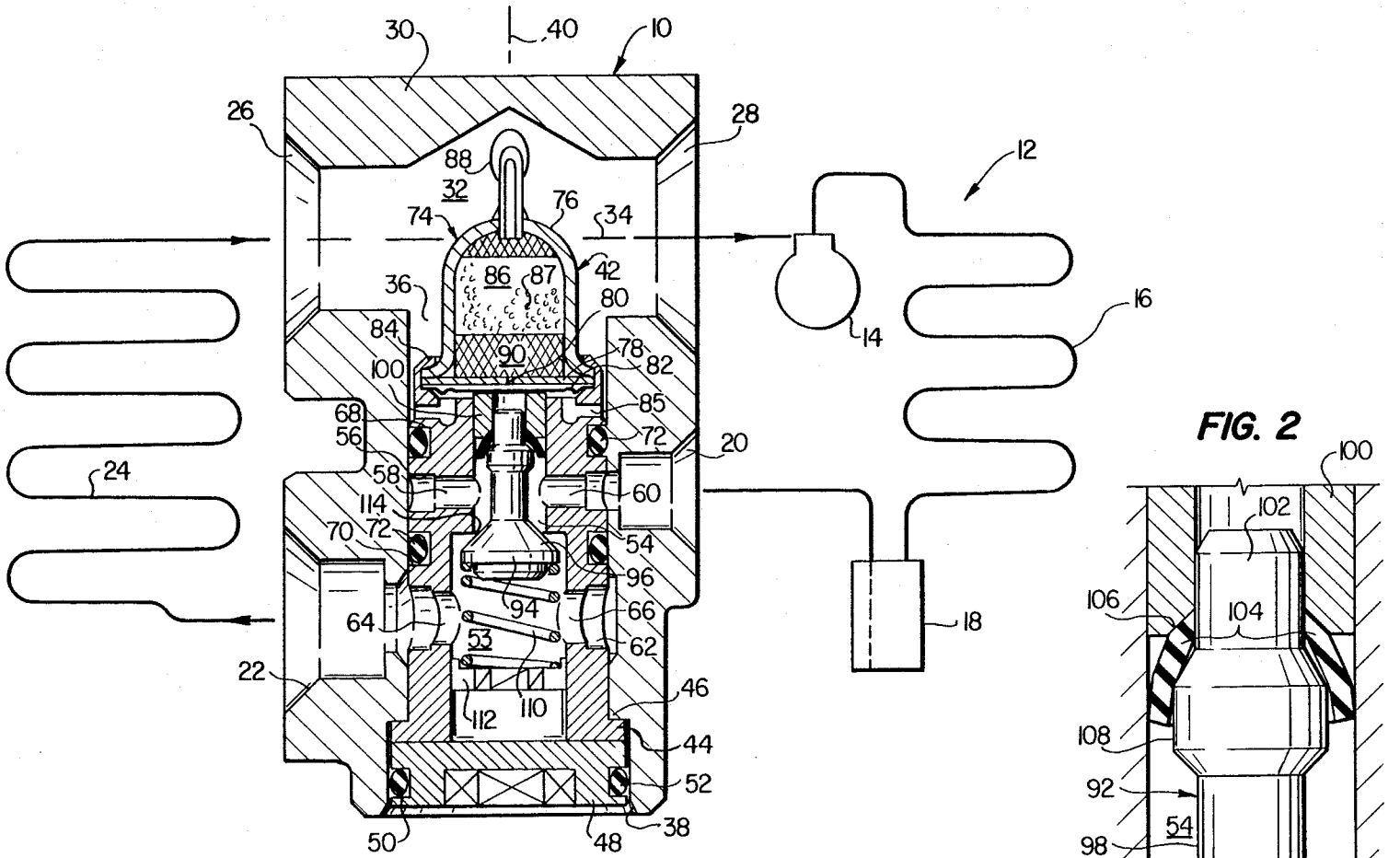
FIG. 1 is cross-sectional view of an expansion valve forming a first embodiment of the present invention.
FIG. 2 is an exploded view of the high pressure seal used in the expansion valve to balance the valve.

With reference to FIG. 1, an expansion valve 10 is illustrated which forms a first embodiment of the present invention. The expansion valve 10 is a component of an air conditioning system 12 for installation in an automobile. The system 12 includes a refrigerant compressor 14 which is commonly driven by the engine. Compressor 14 will compress the refrigerant, typically R12 or other suitable halogenated hydrocarbon. The compressor output is provided to a condenser 16 and receiver/dryer 18 before flowing to the compressor side high pressure refrigerant flow port 20 in valve 10. As will be discussed in detail hereinafter, the refrigerant flow is regulated and its pressure decreased through the valve for exit from the evaporator side pressure refrigerant flow port 22 for delivery to the evaporator 24. The low pressure refrigerant flow from the evaporator flows to an evaporator side low pressure refrigerant flow port 26 in valve 10, passes through valve 10, and exits the valve at compressor suction side low pressure refrigerant flow port 28 for return to the compressor.

The valve 10 includes a body 30 formed of a resin material, such as polyacetal-homopolymer, polyacetal-copolymer, glass fiber reinforced polybutylene terephthalate (PBT), or a glass fiber reinforced polyphenylene sulfide for normal heat resistance requirements. If the heat resistance requirements are severe, the body can be formed of metal, such as an aluminum alloy.

A first passage 32 is formed through the body 30 between ports 26 and 28 and is centered along axis 34. A second passage 36 extends from a threaded end 38 of the valve along axis 40 to intersect the first passage. Ports 20 and 22 open into the passage 36 at spaced positions along the length of the axis 40.

A cartridge 42 is inserted through the end 38 of the body until annular lip 44 on cartridge 42 contacts annular lip 46 on the body. The cartridge is secured within the body with threaded retainer 48. An annular groove 50 in retainer 48 receives an 0-ring 52 to seal between the retainer and passage 36 at end 38.

The cartridge has a passage 53 therethrough, a portion of which defines a uniform diameter central passage 54. The center line of passage 53 coincides with axis 40 when the cartridge is properly positioned within the body 30. An annular groove 56 is formed in the cartridge which faces port 20. Ports 58 and 60 connect the groove 56 to passage 54. An annular groove 62 is also formed in the cartridge which aligns with port 22. Ports 64 and 66 connect groove 62 with passage 53. 0-ring grooves 68 and 70 are formed in the cartridge 42 on either side of groove 56 along the axis 40 to receive 0-rings 72 to seal between the cartridge and wall of passage 36.

Cartridge 42 also supports a power element 74 which extends into the first passage 32 in the low pressure refrigerant flow path between the evaporator and suction side of the compressor. The power element 74 includes a rigid bell-shaped housing 76, a rigid disc 78 having a center aperture 80 and a disc-shaped flexible diaphragm 82. The edges of housing 76, disc 78 and diaphragm 82 are hermetically sealed by soldering to form an airtight gas plenum 86 within the element. The cartridge is formed with a compression lip 84 which crimps the edges of housing 76, disc 78 and diaphragm 82 to secure the power element to the end of cartridge 42 proximate passage 32. Ports 85 expose the outer surface of the flexible diaphragm 82 to the low pressure refrigerant flow.

Within plenum 86 is an adsorption charge, comprising an adsorbent 87 and gas. The charge, for example, can comprise active carbon and R13, or active carbon and carbon dioxide. The internal pressure in the plenum 86 is a function of the temperature of the low pressure refrigerant flow through the passage 32. The position of flexible diaphragm 82 is affected by both the temperature and pressure of the low pressure refrigerant flow in a manner to effectively sense the superheat of the low pressure refrigerant flow. Superheat is the actual temperature minus the vaporization temperature, which is pressure dependent. Preferably, housing 76 is formed of a good heat conductor, such as copper. Tip 88 is a process tube used during manufacture.

As the superheat of the low pressure refrigerant flow in passage 32 varies, the pressure within plenum 86 varies as well. The temperature of the flow in passage 32 affects the pressure within plenum 86 through the interaction of the solid absorbent and gas in the plenum. The gas pressure within plenum 86 acts through aperture 80 on the entire exposed surface area of the flexible diaphragm 82 to flex the diaphragm along axis 40 against the force exerted by the pressure of the low pressure refrigerant flow and the force of spring 110. A screen 90 is provided between disc 78 and the adsorbent to ensure that the adsorbent will not block the aperture 80. The pressure of the flow in passage 32 also affects the position of diaphragm 82 and pressure in plenum 86.

A valve member 92 is positioned within the passage 53 of the cartridge and cooperates with the cartridge to regulate the high pressure refrigerant flow through the expansion valve. The valve member includes a base 94 which defines a conical seal surface 96. Valve member 92 also has a stem 98 extending from base 94 with a diameter generally corresponding to the minimum diameter of seal surface 96, with the stem extending into uniform diameter central passage 54, past ports 58 and 60 to proximate the diaphragm 82. Valve member 92 is preferably formed of stainless steel.

An annular seal retainer 100 is slidably received in the end of central passage 54 proximate the diaphragm. The outer diameter of retainer 100 is sized to fit closely within the central passage, but permit the retainer to slide along the axis 40. The inner diameter is sized to fit closely about a portion of the cylindrical end 102 of stem 98 (see FIG. 2). The retainer can be formed of brass, for example.

A cuplike high pressure seal 104 fits over the cylindrical end 102 of the stem and contacts the wall of the central passage. The concave side of the seal faces the interior of passage 54. On its back, or convex side, the seal 104 is supported by seal retainer 100. When high pressure refrigeration fluid is present in port 20 and the central passage 54, the pressure forces the seal 104 into sealing engagement with the wall of the central passage and end 102 of the stem. The radially inner end 106 of retainer 100 has a recess which accepts the radially inner end of the seal to enhance the seal to the cylindrical end 102. A ring 108 is formed on the stem 98 to hold the radially outward sealing edge of seal 104 against the wall of the central passage so that when the compressor begins operation, the pressurized refrigeration fluid will force the seal into a sealing engagement, rather than pass around the edge of the seal. Preferably, the seal 104 is formed of polytetrafluoroethylene.

Referring again to FIG. 1, spring 110 is positioned within the passage 53 which acts between the end of base 94 and a spring retainer 112 that is threaded into the passage 53. The force exerted by the spring on the base can be adjusted by rotating the retainer to move the retainer along axis 40.

Spring 110 acts in a direction to close the conical seal surface 96 of the valve member 92 against edge 114 at the end of uniform diameter passage 54. By using seal 104, the forces exerted by the pressurized refrigerant from the compressor are balanced on the valve member as the valve moves along axis 40. The flow is modulated in response to the superheat of the low pressure refrigerant flow through passage 32. As superheat transients occur in the low pressure flow, the temperature and pressure variations create an imbalance in the forces acting on diaphragm 82, namely the internal pressure within plenum 86 acting opposite the combined forces of the pressure on the exterior surface of diaphragm 82 and the force exerted by spring 110. The diaphragm will deflect to regain a balance of these forces. Diaphragm 82 acts on the end of seal retainer 100 which, in turn, acts to move the valve member along the axis 40. The interaction between spring 110 and the power element 74 will allow the valve member to move in modulated fashion from the closed position, with conical seal surface 96 sealed against edge 114, progressively to a fully open position, with the flow cross section between the edge 114 and the surface 96 being variable to modulate the flow.

The present invention has significant advantage over prior designs. The body 10 can be formed of an inexpensive resin, which allows a variety of external body shapes and configurations to suit the connector specifications and size requirements of a variety of applications while using a common cartridge. The resin body also acts to thermally isolate the high and low pressure refrigerant flows to allow more accurate measurement of the temperature in the low pressure flow. The only close tolerances required are formed between the valve member 92 and the cartridge 42, each of which are preferably formed of metal. The use of a seal 104 provides a balanced valve member which minimizes the force necessary to move valve member 92 to modulate the refrigerant flow. Consequently, the pressure responsive area of diaphragm 82 can also be minimized to provide a compact cartridge suitable for insertion within a plastic body of practical size, shape, weight and cost.

Although a single embodiment of the invention has been illustrated in the accompanying drawings, and described in the foregoing Detailed Description, it will be understood that the invention is not limited to the embodiment disclosed, but is capable of numerous rearrangements, modifications and substitutions of parts and elements without departing from the scope and spirit of the invention.

We claim:

1. An expansion valve for an air conditioner having an evaporator and a compressor, the expansion valve comprising;

a body assembly defining a first flow path for high pressure refrigerant flow from the compressor to the evaporator and a second flow path for low pressure refrigerant flow from the evaporator to the compressor, a cartridge, including:

(a) a valve member positioned in the first flow path for varying the flow cross section through the first flow path for modulating refrigerant flow;

(b) means positioned within the second flow path for sensing the superheat of the low pressure refrigerant flow and for moving the valve member in response to the sensed superheat to modulate the refrigerant flow;

the cartridge being self-contained and pre-calibrated to modulate the refrigerant flow in response to the superheat sensed independent of the body assembly, permitting use in a variety of body assembly configuration;

the body assembly defining a uniform diameter passage having a first end and a second end, the first flow path opening into the passage through a wall thereof and exiting the first end, the valve member having a first portion defining a conical seal surface and a second portion defining a stem extending from the conical seal surface into the passage and beyond the opening in the passage wall to a cylindrical end;

an annular seal retainer received in the passage proximate the second end thereof which supports the cylindrical end of the stem concentric with a passage center line;

a cup shaped high pressure seal positioned between the cylindrical end of the stem and a wall of the passage and supported by said annular seal retainer to balance pressure forces from the refrigerant acting on the valve member.

2. The expansion valve of claim 1 wherein said cup-shaped high pressure seal is formed of polytetrafluoroethylene.

3. An expansion valve for an air conditioner having an evaporator and a compressor, the expansion valve comprising;

a body defining a first passage therethrough and a second passage extending from an opening in the body and intersecting the first passage;

a cartridge positioned within the second passage and defining a uniform diameter central passage along a portion thereof, the central passage having a first end and a second end, said cartridge including:

(a) a valve member having a base defining a conical seal surface and a stem having a cylindrical end;

(b) an annular seal retainer slidably movable along the wall of the central passage proximate the second end thereof, the inner surface of the annular seal retainer supporting the cylindrical end of the valve member concentric with the axis of the central passage;

(c) a cupshaped high pressure seal positioned between the cylindrical end of the stem and the wall of the central passage and supported by the annular seal retainer;

(d) means for urging the valve member in a first direction along the axis of the central passage to engage the conical seal surface with the first end of the passage to form a seal;

(e) a power element positioned in the first passage for sensing fluid superheat in the first passage and moving the annular seal retainer along the axis of the central passage in response to the superheat sensed; and a flow path being formed through the body and cartridge, opening into the central passage between the cupshaped seal and base along the central passage and continuing past the first end of the central passage for flow of pressurized refrigerant from the output of the compressor, the flow of refrigerant through the first end of the central passage and past the conical seal surface being modulated in response to the superheat to fluid flow through the first passage, the cartridge being self-contained and pre-calibrated to modulate the refrigerant low in response to the superheat sensed independent of the body, permitting use of the cartridge in a variety of body configurations.

4. The expansion valve of the claim 3 wherein the body is formed of a resin selected from the group comprising polyacetal-homopolymer, polyacetal-copolymer, glass fiber reinforced PBT and glass fiber reinforced polyphenylene sulfide.

5. The expansion valve of claim 3 wherein the power element incorporates an adsorbent and a gas, the gas being selected from the group comprising R13 and carbon dioxide.

6. A pre-calibrated self-contained cartridge for modulating refrigerant flow in an air conditioner having an evaporator and a compressor in response to superheat of the low pressure refrigerant flow, the air conditioner including an element defining an opening interconnecting the low pressure refrigerant flow path and the high pressure refrigerant flow path, said cartridge comprising:

a member positioned within the opening and defining a uniform diameter central passage along a portion thereof, the central passage having a first end and a second end;

a valve member having a base defining a conical seal surface and a stem having a cylindrical end;

an annular seal retainer slidably movable along the wall of the central passage proximate the second end thereof, the inner surface of the annular seal retainer supporting the cylindrical end of the valve member concentric with the axis of the central passage;

a cupshaped high pressure seal positioned between the cylindrical end of the stem and the wall of the central passage and supported by the annular seal retainer;

means for urging the valve member in a first direction along the axis of the central passage to engage the conical seal surface with the first end of the passage to form a seal;

a power element mounted on the member and extending into the low pressure refrigerant flow path for sensing fluid superheat in the flow path and moving the annular seal retainer along the axis of the central passage in response to the superheat sensed; and means for sealing between the member and the element with a portion of the high pressure refrigerant flow path formed through the member, the portion opening into the central passage between the cupshaped seal and base along the central passage and continuing past the first end of the central passage for flow of presusrized refrigerant from the output of the compressor, the flow of refrigerant through the first end of the central passage and past the conical seal surface being modulated in response to the superheat of fluid flow through the low pressure refrigerant flow path, the cartridge being self-contained and pre-calibrated to modulate the refrigerant flow in response to the superheat of the low pressure refrigerant flow independent of the element.

* * * * *